US010385772B2

(12) United States Patent
Takagishi et al.

(10) Patent No.: US 10,385,772 B2
(45) Date of Patent: Aug. 20, 2019

(54) FORMING METHOD OF THERMAL INSULATION FILM AND INTERNAL COMBUSTION ENGINE

(71) Applicants: TOYOTA JIDOSHA KABUSHIKI KAISHA, Toyota-shi, Aichi-ken (JP); KABUSHIKI KAISHA TOYOTA CHUO KENKYUSHO, Nagakute-shi, Aichi-ken (JP)

(72) Inventors: Reona Takagishi, Toyota (JP); Naoki Nishikawa, Toyota (JP); Masaaki Tani, Nagakute (JP); Toshio Horie, Nagakute (JP); Fumio Shimizu, Nagakute (JP); Hiroshi Hohjo, Nagakute (JP); Yoshifumi Wakisaka, Nagakute (JP); Masakazu Murase, Nagakute (JP)

(73) Assignees: TOYOTA JIDOSHA KABUSHIKI KAISHA, Toyota-shi, Aichi-ken (JP); KABUSHIKI KAISHA TOYOTA CHUO KENKYUSHO, Nagakute-shi, Aichi-ken (JP)

( * ) Notice: Subject to any disclaimer, the term of this patent is extended or adjusted under 35 U.S.C. 154(b) by 218 days.

(21) Appl. No.: 14/974,291

(22) Filed: Dec. 18, 2015

(65) Prior Publication Data

US 2016/0186654 A1 Jun. 30, 2016

(30) Foreign Application Priority Data

Dec. 26, 2014 (JP) ..... 2014-265591

(51) Int. Cl.
*F02B 77/02* (2006.01)
*C25D 11/24* (2006.01)
*F01L 3/04* (2006.01)

(52) U.S. Cl.
CPC ..... *F02B 77/02* (2013.01); *C25D 11/246* (2013.01); *F01L 3/04* (2013.01)

(58) Field of Classification Search
CPC ..... F02B 77/02; C25D 11/246
USPC ..... 123/668
See application file for complete search history.

(56) References Cited

U.S. PATENT DOCUMENTS

| | | | | | |
|---|---|---|---|---|---|
| 4,782,107 | A * | 11/1988 | Lagarde | C08K 3/22 | 524/433 |
| 8,893,693 | B2 * | 11/2014 | Hijii | C25D 11/04 | 123/668 |
| 9,702,052 | B2 * | 7/2017 | Nishikawa | C25D 11/18 | |
| 2013/0146041 | A1 * | 6/2013 | Hijii | C25D 11/04 | 123/668 |
| 2013/0255651 | A1 | 10/2013 | Nomura et al. | | |
| 2014/0245994 | A1 * | 9/2014 | Nishikawa | C25D 11/246 | 123/434 |
| 2015/0104626 | A1 * | 4/2015 | Tomita | C09D 1/00 | 428/213 |
| 2016/0177818 | A1 | 6/2016 | Nishikawa et al. | | |

FOREIGN PATENT DOCUMENTS

| | | | |
|---|---|---|---|
| CN | 103842560 | A | 6/2014 |
| CN | 105452503 | A | 3/2016 |
| JP | 58-192949 | A | 11/1983 |
| JP | 2005-060720 | A | 3/2005 |
| JP | 2012-072745 | A | 4/2012 |
| JP | 2013-060620 | A | 4/2013 |
| JP | 2015-031226 | A | 2/2015 |
| WO | 2013/0382249 | * | 3/2013 |
| WO | 2013/191263 | * | 12/2013 |
| WO | 2015/019145 | A2 | 2/2015 |

* cited by examiner

*Primary Examiner* — Margaret G Moore
(74) *Attorney, Agent, or Firm* — Sughrue Mion, PLLC

(57) ABSTRACT

A forming method of a thermal insulation film includes a first step of forming an anode oxidation coating film on an aluminum-based wall surface, the anode oxidation coating film including micro-pores each having a diameter of micrometer-scale and nano-pores each having a diameter of nanometer-scale; and a second step of coating a surface of the anode oxidation coating film with a sealant containing filler to seal at least part of the micro-pores and the nano-pores by the sealant so as to form the thermal insulation film.

12 Claims, 4 Drawing Sheets

FORMING METHOD OF THERMAL INSULATION FILM AND INTERNAL COMBUSTION ENGINE

The disclosure of Japanese Patent Application No. 2014-265591 filed on Dec. 26, 2014 including the specification, drawings and abstract is incorporated herein by reference in its entirety.

BACKGROUND OF THE INVENTION

1. Field of the Invention

The invention relates to a forming method of a thermal insulation film which is formed on e.g. a wall surface of an internal combustion engine that is located in a combustion chamber, and an internal combustion chamber at least part of which is provided with the thermal insulation film formed by the forming method.

2. Description of Related Art

An internal combustion engine, such as gasoline engine, diesel engine, and the like, is mainly composed of a cylinder block, a cylinder head, and a piston, and its combustion chamber is delimited by a surface of a bore of the cylinder block, a top surface of the piston inserted in the bore, a bottom surface of the cylinder head, and top surfaces of an intake valve and an exhaust valve provided in the cylinder head. As high output from the internal combustion engine is increasingly demanded recently, it becomes important to reduce its cooling loss. As one of the solutions to reduce the cooling loss, a method may be proposed in which a thermal insulation film formed by ceramic is formed on an inner wall of the combustion chamber.

However, the above ceramics generally has low thermal conductivity and high thermal capacity, thus steady rise of the surface temperature may incur reduction of intake efficiency and knocking (abnormal combustion caused by heat accumulated in the combustion chamber), and therefore the material as the thermal insulation film for the inner wall of the combustion chamber has not been widely used.

Therefore, it is desirable that the thermal insulation film formed on the wall surface of the combustion chamber is formed by material which not only is heat resistant and heat insulative, but also has low thermal conductivity and low thermal capacity. That is, in order to lower the temperature of the wall surface by following temperature of fresh gas during the intake stroke, it is preferable to have low thermal capacity, so that the temperature of the wall surface would not be steadily raised. Moreover, in addition to the low thermal conductivity and low thermal capacity, it is also desirable that the thermal insulation film is formed by material which can withstand explosion pressure in the combustion chamber upon combustion, injection pressure, and repeated stresses caused by thermal expansion and thermal contraction, and has high adherence with base material of the cylinder block and the like.

Here, attention is directed to published prior art. Japanese Patent Application Publication No. 58-192949 (JP 58-192949 A) discloses a piston and a manufacturing method therefor, wherein an alumite layer is formed on a top surface of the piston, and a ceramic layer is formed on a surface of the alumite layer. With this piston, its heat resistance and thermal insulation are made excellent by forming the alumite layer on the top surface.

As such, by forming the alumite layer (anode oxidation coating film) on a wall surface of an internal combustion engine that is located in the combustion chamber, it is possible to form an internal combustion engine having excellent thermal insulation, low thermal conductivity, and low thermal capacity. Also, in addition to these properties, it has excellent swing property which is also important performance required by an anode oxidation coating film. Here, "swing property" means that the anode oxidation coating film has thermal insulation performance and its temperature follows temperature of the gas in the combustion chamber.

When being observed microscopically, the above anode oxidation coating film takes a structure having a plurality of adjacent cells, and has a lot of cracks on its surface, wherein a portion of the cracks extend inwardly (that is, extend in thickness direction or approximately in thickness direction of the anode oxidation coating film). There are also lots of internal defects within the film that extend in directions other than the thickness direction (horizontal direction orthogonal to the thickness direction or approximately the horizontal direction). Moreover, it is known that these cracks and internal defects are micro-pores each having a diameter (or maximum diameter in cross sectional dimensions) of micrometer-scale approximately ranging from 1 μm to several tens of μm. Furthermore, the "cracks" stem from crystalline matter of aluminum alloy for casting.

Moreover, inside the anode oxidation coating film, in addition to the above cracks and internal defects of micrometer-scale, there are also many small pores each having a diameter of nanometer-scale (nano-pores), and generally, the nano-pores are also present in a state where they extend from the surface of the anode oxidation coating film in its thickness direction or approximately in the thickness direction. Furthermore, the "nano-pores" stem from anode oxidation treatment and are arranged regularly.

As such, the formed anode oxidation coating film generally includes therein micro-pores such as surface cracks, internal defects or the like having a diameter or maximum dimension in cross-section of micrometer-scale, and a plurality of nano-pores of nanometer-scale.

However, if the surface roughness of the thermal insulation film constructed by the above anode oxidation coating film is large, abnormal combustion may be easily incurred, resulting in degradation in fuel efficiency. Therefore, in order to lower the surface roughness of the thermal insulation film constructed by the anode oxidation coating film, generally the surface is abraded. At this time, since the anode oxidation coating film has a plurality of micro-pores therein as described above, there is the issue that the smoothness of the surface of the thermal insulation film cannot be improved due to appearance of internal micro-pores on the surface even after repeated abrasion.

Here, in Japanese Patent Application Publication No. 2012-72745 (JP 2012-72745 A), a thermal insulation structure is disclosed, wherein a porous layer is formed on a surface of a base material made from aluminum alloy by anode oxidation treatment, and a covering layer having lower thermal conductivity than the base material is provided on the porous layer. By way of the anchor effect brought by surface unevenness of the porous layer, adherence of the porous layer with the covering layer is improved. However, since the surface of the porous layer (anode oxidation coating film) has unevenness, despite the covering layer provided on the porous layer, the surface unevenness may be largely reflected at the surface of the covering layer, so surface roughness of the thermal insulation film constructed by the porous layer and the covering layer cannot be improved.

SUMMARY OF THE INVENTION

The invention provides a forming method of a thermal insulation film, which is capable of effectively reducing surface roughness of the thermal insulation film that includes an anode oxidation coating film having a plurality of micro-pores.

A forming method of thermal insulation film according to a first aspect of the invention includes the following steps: a first step of forming an anode oxidation coating film on a surface of an aluminum-based base material, the anode oxidation coating film including micro-pores each having a diameter of micrometer-scale and nano-pores each having a diameter of nanometer-scale; and a second step of coating a surface of the anode oxidation coating film with a sealant containing filler to seal at least part of the micro-pores and the nano-pores by the sealant so as to form the thermal insulation film.

The forming method according to the above aspect is applicable to an aluminum-based wall surface such as a top surface of a piston, an engine cylinder block, and so on constituting a combustion chamber. By coating the surface of the anode oxidation coating film with the sealant containing filler after the anode oxidation coating film is formed on the aluminum-based wall surface, the filler is brought into the micro-pores especially at the surface of the anode oxidation coating film to seal the micro-pores by the sealant, whereby it is possible to effectively improve the surface roughness of the thermal insulation film to form a thermal insulation film having low surface roughness.

Here, "micro-pores" collectively refers to cracks each having a diameter of micrometer-scale and extending inwardly from the surface of the anode oxidation coating film, and internal defects not located at the surface of the anode oxidation coating film but present inside the coating film. In addition, in the present specification, "diameter" of the micro-pores, nano-pores, or the like means the nominal diameter in the case of cylindrical shape, and the length of the longest side in the cross-section in the case of elliptically columnar shape or prismatic shape. Therefore, for pores in the shapes other than cylindrical shape, "diameter" is regarded as a diameter of an equivalent circle having the same area.

In addition, to "seal" the micro-pores and nano-pores means coating or the like of a sealant containing filler with respect to the cracks and internal defects forming the pores, and filling of the pores by a seal containing filler that is converted by the sealant containing filler.

In addition, according to the inventors, the diameter or maximum size in cross-section of the micro-pores of micrometer-scale included in the anode oxidation coating film formed on the wall surface of the internal combustion engine that is located in the combustion chamber is determined to be generally in an range from about 1 μm to several tens of μm, and the diameter or maximum size in cross-section of the nano-pores of nanometer-scale is determined to be generally in a range from about 10 to 100 nm. Furthermore, determination of the above range from 1 μm to several tens of μm and that from 10 to 100 nm can be carried out by extracting some micro-pores, nano-pores in a certain area with respect to SEM image photograph data, TEM image photograph data of the cross section of the anode oxidation coating film, measuring the diameters or maximum sizes thereof, and averaging the respective measurements.

Herein, the sealant is preferably formed by material having silicon as a main constituent.

In addition, as the sealant, any one of polysiloxane, polysilazane, and sodium silicate may be used, while it is preferable to use polysiloxane and polysilazane of coating material that has a viscosity capable of making them smoothly permeate into the micro-pores, nano-pores in the anode oxidation coating film and contains room-temperature solidified inorganic substance. The coating material that contains room-temperature solidified inorganic substance can be solidified without being subjected to high temperature heating treatment (firing), and the seal formed by solidifying has an extremely high hardness. In addition, in order to fill the cracks and internal defects forming the micro-pores and nano-pores, the filler contained in the sealant needs to have a suitable size, which is specifically in a range from 10 nm to 1 μm, and preferably from about 10 nm to 100 nm.

In addition, the invention relates to an internal combustion engine. The internal combustion engine according to a second aspect of the invention is an internal combustion engine in which a portion or all of aluminum-based wall surfaces of a combustion chamber is formed with an anode oxidation coating film, and which assumes the following structure: the anode oxidation coating film includes first micro-pores each having a diameter of micrometer-scale and nano-pores each having a diameter of nanometer-scale that extend inwardly in a thickness direction or approximately in the thickness direction of the anode oxidation coating film from a surface of the anode oxidation coating film, and second micro-pores located inside the anode oxidation coating film and each having a diameter of micrometer-scale. At least part of the first micro-pores and the nano-pores are sealed by a seal containing filler, the seal being converted by a sealant containing filler, and at least part of the second micro-pores are not sealed.

The internal combustion engine according to the above second aspect, a portion or all of whose combustion chamber is provided with the anode oxidation coating film (or thermal insulation film), can have a high porosity and high thermal insulation by assuming the following structure even in the case of a small film thickness. The structure is such that at least part of the first micro-pores each having a diameter of micrometer-scale and the nano-pores each having a diameter of nanometer-scale that extend inwardly in a thickness direction or approximately in the thickness direction of the anode oxidation coating film from a surface of the anode oxidation coating film are sealed by the seal containing filler. On the other hand, at least part of the second micro-pores present inside the coating film are not sealed. As such, by sealing at least part of the first micro-pores and the nano-pores by the seal containing filler, smoothness of the surface of the thermal insulation film becomes good, and thus the fuel efficiency is improved and it is possible to suppress combustion gas under high temperature and high pressure in the cylinders of the engine from entering inside of the film. If the combustion gas cannot be suppressed from entering inside of the film, the thermal insulation effect will be lost at a portion of the film where gas enters, and thus the thermal insulation effect of the film as a whole will be lowered. On the other hand, if being sealed as described above, it is possible to suppress the combustion gas from entering inside of the film and thus it is possible to fully exhibit the thermal insulation performance of the film itself.

Herein, the "first micro-pores" means the cracks extending inwardly from the surface of the anode oxidation coating film, and the "second micro-pores" means the internal defects not located at the surface of the anode oxidation coating film but present inside the coating film.

In addition, "at least part of the first micro-pores and the nano-pores are sealed by the seal containing filler, the seal being converted by a sealant containing filler" means that, besides a configuration where all of the first micro-pores each having a diameter of micrometer-scale and the nano-pores each having a diameter of nanometer-scale present in the anode oxidation coating film are sealed by the seal containing filler, a configuration where the first micro-pores and the nano-pores in a range from a surface layer to a certain depth of the anode oxidation coating film are sealed while the first micro-pores and the nano-pores in a deeper range are not sealed, and so on, are also included.

In addition, "at least part of the second micro-pores are not sealed" means that, besides a configuration where all of the second micro-pores each having a diameter of micrometer-scale and present within the anode oxidation coating film are not sealed, a configuration where the second micro-pores present in a range from a surface layer to a certain depth of the anode oxidation coating film are sealed while the second micro-pores present in a deeper range are not sealed, and a configuration where the surrounding areas of the second micro-pores are covered by the seal containing filler while the inside of the second micro-pores is not filled by the seal, and so on, are also included.

In the anode oxidation coating film in which all of the second micro-pores that are not located at the surface of the coating film but are present inside the coating film are not sealed, it is possible to ensure a high porosity and achieve an anode oxidation coating film having excellent thermal insulation performance. In fact, however, the second micro-pores that communicate with the first micro-pores and the nano-pores located at the surface of the coating film are also permeated with the sealant containing filler, and also sealed by the seal containing filler.

The first micro-pores and the nano-pores extend in a thickness direction or approximately in the thickness direction of the anode oxidation coating film. Here, "approximately in the thickness direction" means a configuration where the pores extend in a direction inclined from the thickness direction, a configuration where the pores extend meanderingly in the thickness direction, and so on.

On the other hand, the second micro-pores, e.g. inside of the anode oxidation coating film, may take a configuration of extending in a direction orthogonal to the thickness direction of the anode oxidation coating film, a configuration of extending in a direction inclined from the direction orthogonal to the thickness direction, a configuration of extending meanderingly in the direction orthogonal to the thickness direction, and so on.

The internal combustion engine according to the above second aspect may be an internal combustion engine with either of a gasoline engine and a diesel engine as an object, which, as mentioned above, is mainly constructed by a cylinder block, a cylinder head and a piston, and a combustion chamber of which is delimited by a surface of a bore of the cylinder block, a top surface of the piston inserted in the bore, a bottom surface of the cylinder head, and top surfaces of an intake valve and an exhaust valve provided in the cylinder head.

Furthermore, the above-described anode oxidation coating film may be formed on all the wall surfaces of the combustion chamber, and may also be formed on a portion thereof. In the latter, embodiments in which the coating film is formed only on the top surface of the piston, or only on the top surfaces of the valves, and so on, may be enumerated.

In addition, as the base material for constructing the combustion chamber of the internal combustion engine, aluminum or alloy thereof, and aluminum plated iron-based material, or the like may be enumerated, and the anode oxidation coating film formed on their wall surfaces becomes alumite.

In the internal combustion engine according to the above second aspect, by taking a structure in which all or part of the second micro-pores of micrometer-scale are not sealed, an anode oxidation coating film having a high porosity can be formed, and the anode oxidation member may have excellent thermal insulation performance even having a relatively small film thickness ranging e.g. from 30 μm to 170 μm.

As can be appreciated from the above description, by using the forming method of thermal insulation film according to the aspects of the invention, a sealant containing filler is coated on a surface of the anode oxidation coating film, at least part of the micro-pores and the nano-pores are sealed by the sealant to form the thermal insulation film. Therefore, the filler is brought into the micro-pores especially at the surface of the anode oxidation coating film, thereby it is possible to seal the micro-pores by the sealant, to effectively improve the surface roughness of the thermal insulation film, and thus to form the thermal insulation film having low surface roughness.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, embodiments of the forming method of thermal insulation film according to the invention will be described with reference to the accompanying drawings.

(Embodiments of the Forming Method of Thermal Insulation Film)

Figure 1:
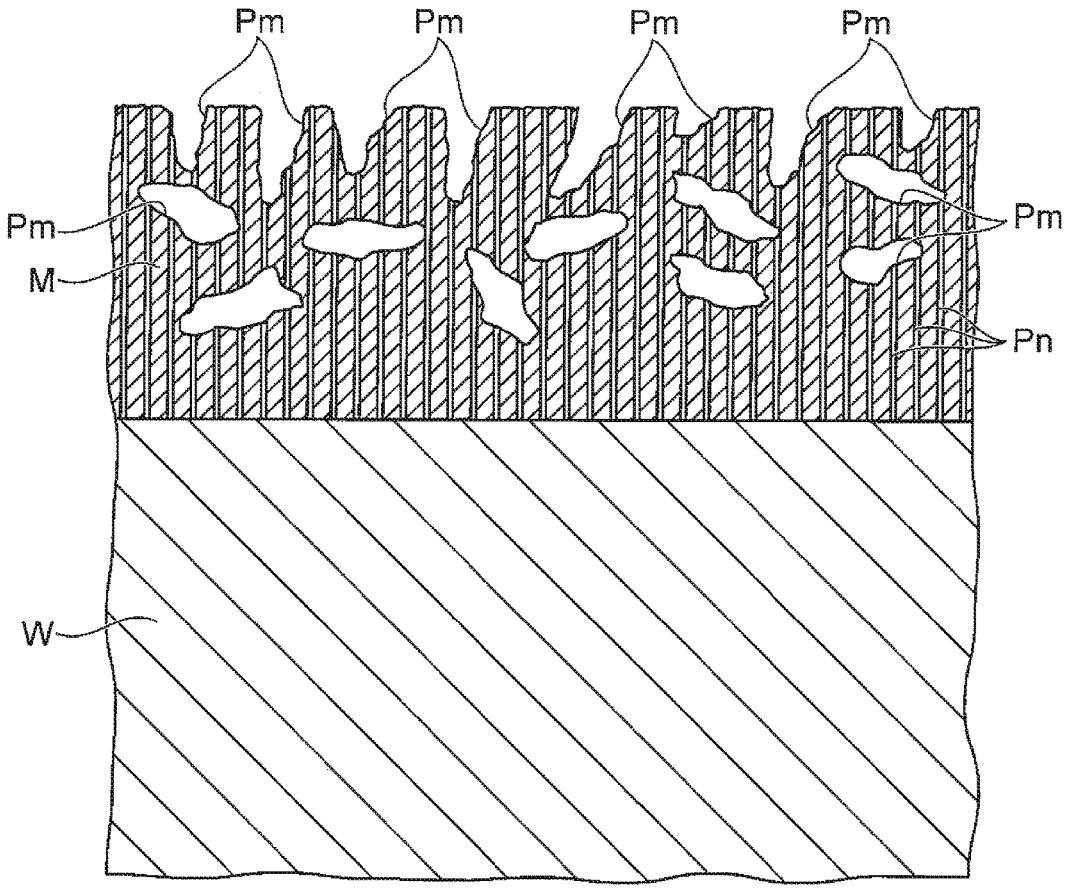
FIG. 1 is a schematic diagram illustrating the first step of the forming method of thermal insulation film according to the invention.
Figure 2:
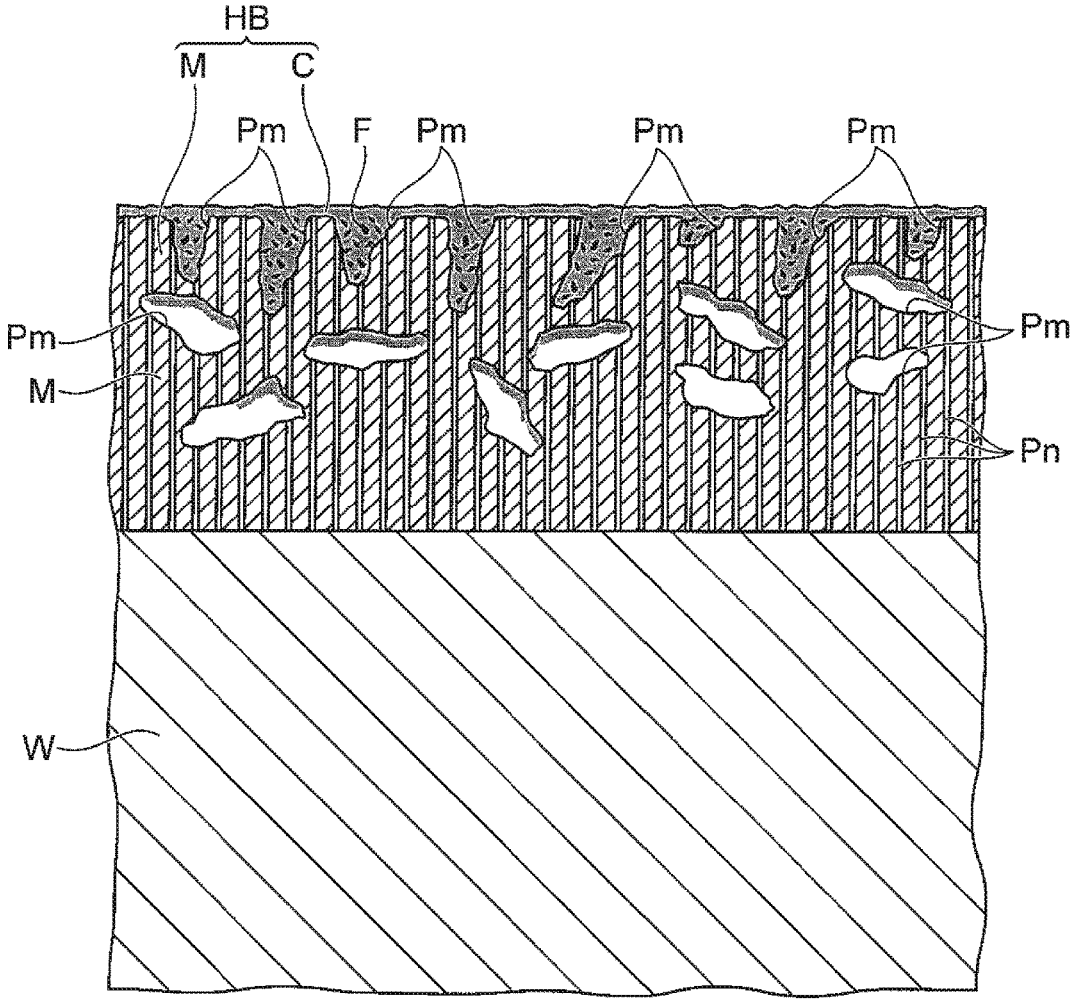
FIG. 2 is a schematic diagram illustrating the second step of the forming method of thermal insulation film.

FIG. 1 is a schematic diagram illustrating the first step in the forming method of thermal insulation film according to the invention. FIG. 2 is a schematic diagram illustrating the second step.

Firstly, as shown in FIG. 1, an anode oxidation coating film M is formed on a surface of an aluminum-based wall surface W (first step). For the aluminum-based wall surface W, it may be enumerated aluminum or alloy thereof, material formed by plating iron-based material with aluminum and subjecting to anode oxidation treatment, and so on, wherein the anode oxidation coating film M formed on the wall surface having aluminum or aluminum alloy as base material becomes alumite.

As shown in FIG. 1, when the anode oxidation coating film formed on the surface of the aluminum-based wall surface W is microscopically observed, there are micro-pores Pm (longitudinal cracks) extending in the thickness direction or approximately in the thickness direction of the anode oxidation coating film M and having a diameter of micrometer-scale on the surface of the anode oxidation coating film, and there are additional micro-pores Pm (internal defects) extending in the horizontal direction or approximately in the horizontal direction of the anode oxidation coating film M and having a diameter of micrometer-scale at the inside of the anode oxidation coating film.

Moreover, among these micro-pores Pm, the diameter or maximum size in cross-section of the micro-pores Pm is about in a range from 1 μm to several tens of μm. Furthermore, not only in the case of normal aluminum alloy, but also in the case where the aluminum alloy additionally contains any of Si, Cu, Mg, Ni, and Fe, the diameter or size in cross-section of the micro-pores Pm tends to further increase.

Furthermore, as shown in FIG. 1, at the inside of the anode oxidation coating film M, in addition to the micro-pores Pm of micrometer-scale, there are also a plurality of small pores of nanometer-scale (nano-pores Pn), and similar to the micro-pores Pm, the nano-pores Pn also extend in the thickness direction or approximately in the thickness direction of the anode oxidation coating film M. Moreover, the diameter or maximum size in cross-section of the nano-pores Pn is about in the range from 10 to 100 nm.

Next, as shown in FIG. 2, by coating a sealant C containing filler F on the surface of the anode oxidation coating film M, a thermal insulation film HB constructed by a seal C containing filler F and the anode oxidation coating film M is formed, wherein the seal C is converted by the sealant C containing filler F. Furthermore, the seal C, in addition to entering the micro-pores Pm and the nano-pores Pn at the surface of the anode oxidation coating film M to fill these pores so as to improve the strength of the film, also becomes a protection film for protecting the surface of the anode oxidation coating film M.

Here, as the sealant C used, polysiloxane, polysilazane or the like that can be converted into silicon through a heating treatment may be enumerated, and specifically, as the above polysiloxane, methyl silicate, ethyl silicate, propyl silicate or the like, and silane alkoxide may be conceived. By using these, it is possible to smoothly permeate into the small micro-pores Pm and nano-pores Pn, to be converted into silicon at a relatively low temperature, to become a solidified body such as silica glass having high hardness after solidifying, and thus improve the strength of the anode oxidation coating film M.

In addition, as the filler F used, such filler as silicon, alumina, boron nitride, silicon nitride, silicon carbide, magnesium oxide may be used.

In addition, as the coating method for the sealant C containing the filler F, a method in which the anode oxidation coating film M is impregnated in a container receiving the sealant C, a method in which the sealant C containing the filler F is sprayed to the surface of the anode oxidation coating film M, a blade coating method, a spinning coating method, a brushing coating method, and so on may be used.

Since the sealant C contains the filler F, the filler F can be brought into the micro-pores Pm especially at the surface of the anode oxidation coating film M, and the micro-pores Pm are sealed by the sealant C, whereby the surface roughness of the thermal insulation film HB can be effectively improved, and the thermal insulation film having low surface roughness can be formed.

In addition, as shown in FIG. 2, the thermal insulation film HB having the following structure is formed: the micro-pores Pm and the nano-pores Pn exposed at the surface of the anode oxidation coating film M are sealed by the seal C containing the filler F that is converted by the sealant C; on the other hand, the micro-pores Pm present inside the anode oxidation coating film M are not sealed or are almost not sealed. Therefore, it is possible to ensure a high porosity and become a thermal insulation film HB having excellent thermal insulation performance.

Figure 3:
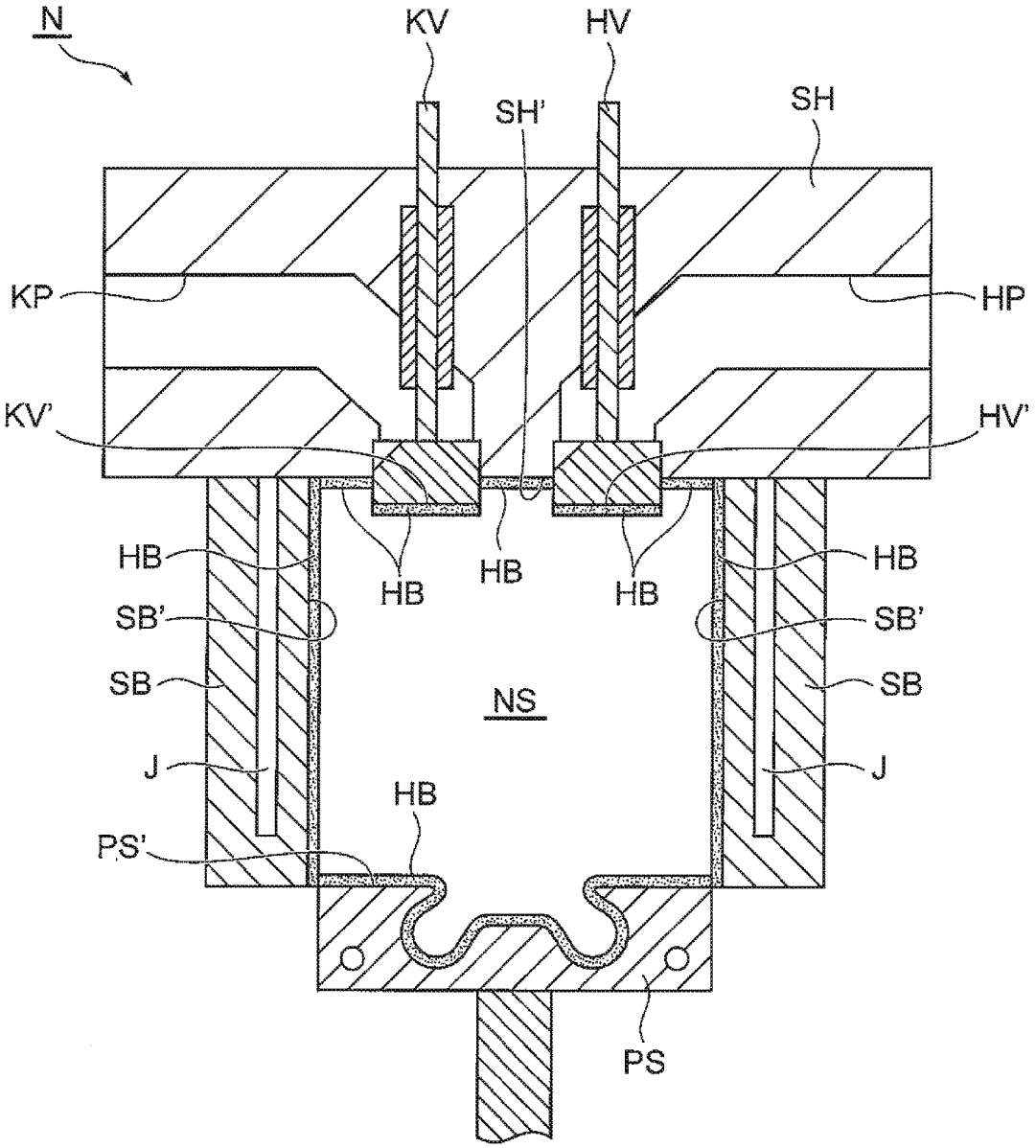
FIG. 3 is a longitudinal sectional view showing the simulation of an internal combustion engine in which a thermal insulation film is formed on all the wall surfaces of the combustion chamber.

Next, an application example of the forming method of thermal insulation film as shown will be described with reference to FIG. 3. Here, FIG. 3 simulates an internal combustion engine in which all the wall surfaces of a combustion chamber are formed with the thermal insulation film HB.

The internal combustion engine N as shown, with a diesel engine as its object, is generally constructed by the following components: a cylinder block SB inside of which a cooling water jacket J is formed, a cylinder head SH provided on the cylinder block SB, an intake port KP and an exhaust port HP formed in the cylinder head SH as well as an intake valve KV and an exhaust valve HV mounted to be freely liftable in respective openings in the combustion chamber NS, and a piston PS formed to be freely moved up and down in an opening below the cylinder block SB.

The components constituting the internal combustion engine N are all formed from aluminum or aluminum alloy (including high strength aluminum alloy). Moreover, especially by containing any least one of Si, Cu, Mg, Ni, and Fe in the aluminum-based material as an alloy composition, it is possible to facilitate enlargement of the opening size of the micro-pores Pm and achieve improvement of porosity.

In the combustion chamber NS delimited by the components of the internal combustion engine N, the forming method as shown is respectively applied to the wall surfaces of the combustion chamber NS (a surface SB' of the bore of the cylinder block, a bottom surface SH' of the cylinder head, a top surface PS' of the piston, and top surfaces KV', HV' of the valves), so that the thermal insulation film HB is formed on the respective wall surfaces. Furthermore, although not shown in the figures, of course, only a portion of the surfaces of the components constituting the internal combustion engine N may be formed with the thermal insulation film HB by using the forming method of thermal insulation film according to the invention.

(Experiments and Results Regarding the Surface Roughness of the Thermal Insulation Film)

Respective thermal insulation films of embodiments 1~9 and comparative examples 1~3 are formed by the inventors on the surface of the base material under the film formation conditions listed in Table 1, and experiments to measure the surface roughness of the thermal insulation films are carried out by the following experiment steps.

TABLE 1

| | Current density (mA/cm$^2$) | Film thickness of the formed film (μm) | Sealant | Filler | | |
|---|---|---|---|---|---|---|
| Embodiment 1 | 51.6 | 70 | methyl silicate | Diameter of silicon dioxide sol: 10~15 nm (Solvent: isopropanol) | Spinning coating (600 rpm, 30 seconds) | 180° C., 8 hours |
| Embodiment 2 | | | | Diameter of silicon dioxide sol: 40~50 nm (Solvent: isopropanol) | | |

TABLE 1-continued

| | Current density (mA/cm$^2$) | Film thickness of the formed film (μm) | Sealant | Filler | |
|---|---|---|---|---|---|
| Embodiment 3 | | | | Diameter of silicon dioxide sol: 70~100 nm (Solvent: isopropanol) | |
| Comparative example 1 | | | | — | |
| Embodiment 4 | | | | Diameter of silicon dioxide sol: 10~15 nm (Solvent: isopropanol) | Spinning Coating (300 rpm, 30 seconds) |
| Embodiment 5 | | | | Diameter of silicon dioxide sol: 40~50 nm (Solvent: isopropanol) | |
| Embodiment 6 | | | | Diameter of silicon dioxide sol: 70~100 nm (Solvent: isopropanol) | |
| Comparative example 2 | | | | — | |
| Embodiment 7 | | | | Diameter of silicon dioxide sol: 10~15 nm (Solvent: isopropanol) | Spinning coating (150 rpm, 30 seconds) |
| Embodiment 8 | | | | Diameter of silicon dioxide sol: 40~50 nm (Solvent: isopropanol) | |
| Embodiment 9 | | | | Diameter of silicon dioxide sol: 70~100 nm (Solvent: isopropanol) | |
| Comparative example 3 | | | | — | |

<Experiment Steps>

(1) Forming an anode oxidation coating film with a film thickness of 70 μm under the condition of a current density of 51.6 mA/cm$^2$, for an aluminum sample with sizes of 20×40×2 mm (thickness).

(2) Measuring surface roughness of the anode oxidation coating film with reference to JIS B0601.

(3) Mixing and stirring sealant and filler in the combinations listed in table 1.

(4) Performing film formation by spinning coating the mixture of the sealant and the filler.

(5) Firing at 180° C. for 8 hours using a furnace.

(6) Measuring surface roughness of the anode oxidation coating film with reference to JIS B0601.

<Experiment Results>

Measurement results regarding the surface roughness is shown in Table 2 below and FIG. 4.

TABLE 2

| | Surface roughness Ra | | Ratio of the surface |
|---|---|---|---|
| | Before coating | After coating | roughnesses before and after coating (%) |
| Embodiment 1 | 5.12 | 3.32 | 65 |
| Embodiment 2 | 5.51 | 4.49 | 81 |
| Embodiment 3 | 5.40 | 3.86 | 71 |
| Comparative example 1 | 5.27 | 5.17 | 98 |
| Embodiment 4 | 5.02 | 2.78 | 55 |
| Embodiment 5 | 4.68 | 2.55 | 54 |
| Embodiment 6 | 4.99 | 3.58 | 72 |
| Comparative example 2 | 5.16 | 4.80 | 93 |
| Embodiment 7 | 4.86 | 1.72 | 35 |
| Embodiment 8 | 4.68 | 1.51 | 32 |
| Embodiment 9 | 4.82 | 1.74 | 36 |

TABLE 2-continued

| | Surface roughness Ra | | Ratio of the surface |
|---|---|---|---|
| | Before coating | After coating | roughnesses before and after coating (%) |
| Comparative example 3 | 5.02 | 4.76 | 95 |

Figure 4:
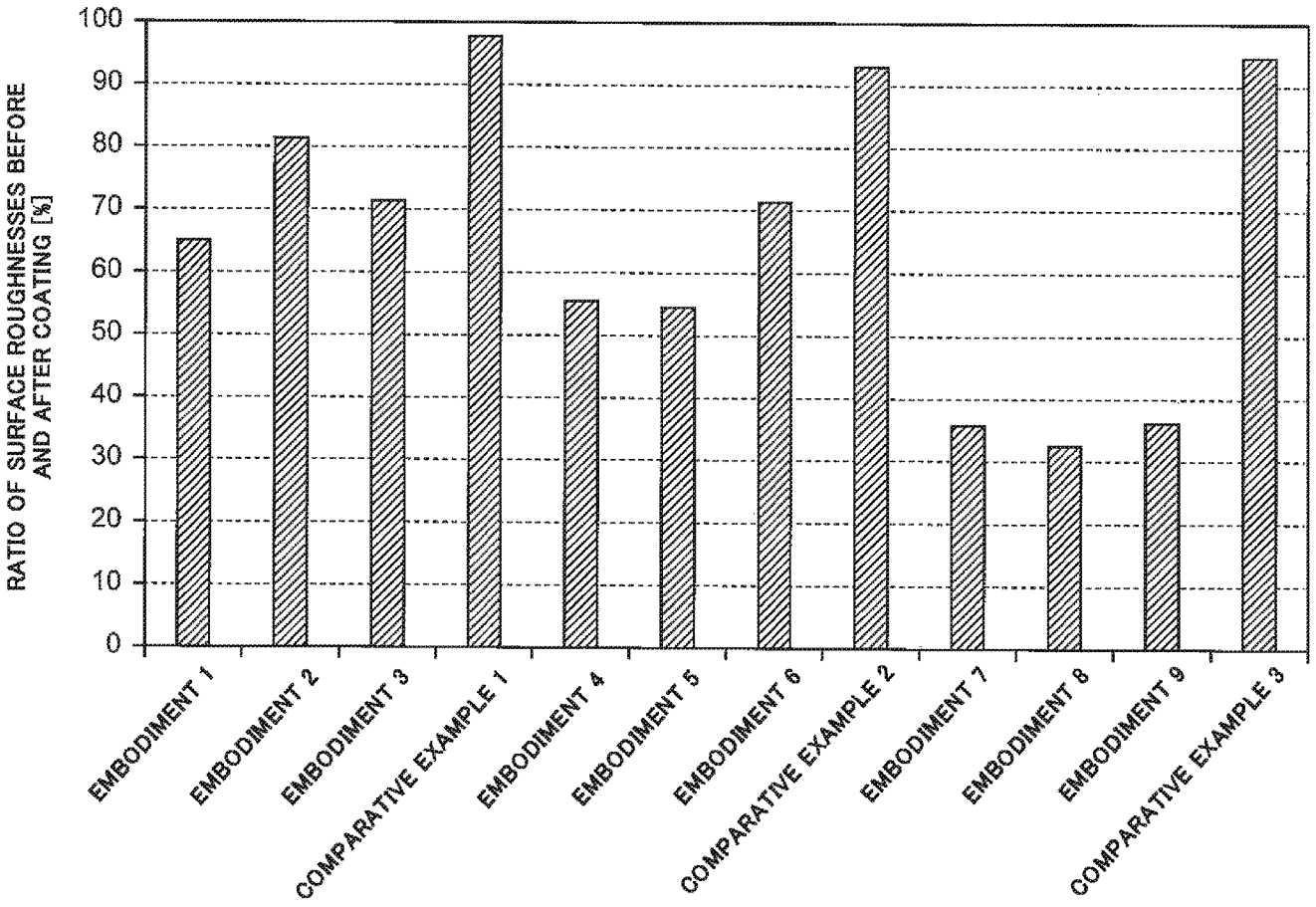
FIG. 4 is a graph showing experiment results concerning the surface roughness.

From Table 2 and FIG. 4, it can be known that in the comparative examples 1 to 3, the ratio of the surface roughnesses before and after coating are all above 90%, and no significant improvement is observed. In contrast, in the embodiments 1-9, the ratio of the surface roughnesses before and after coating is about 30 to 80%, and there is a large improvement as compared with the comparative examples. From the experiment results, it can be confirmed that the surface roughness of the coating film can be improved by using the sealant containing filler.

Embodiments of the invention have been described above with reference to the accompanying drawings, nevertheless the specific constructions are not limited to the embodiments, and design modifications without departing from the scope of gist of the invention are also included in the invention.

What is claimed is:

1. An internal combustion engine in which a portion or all of aluminum-based wall surfaces of a combustion chamber is formed with an anode oxidation coating film, wherein:

the anode oxidation coating film includes first micro-pores each having a diameter of micrometer-scale and nano-pores each having a diameter of nanometer-scale that extend inwardly in a thickness direction or approximately in the thickness direction of the anode oxidation coating film from a surface of the anode oxidation coating film, and second micro-pores located inside the anode oxidation coating film and each having a diameter of micrometer-scale;

at least part of the first micro-pores and the nano-pores are sealed by a seal containing filler particles, the seal being converted by a sealant containing the filler particles, and at least part of the second micro-pores are not sealed;

the filler particles have a size from 10 to 100 nm;

the filler particles are present in at least some of the sealed nano-pores; and a surface roughness Ra of the anode oxidation coating film is from 1.51 to 4.49.

2. The internal combustion engine according to claim 1, wherein the sealant and the seal are formed by material having silicon as a main constituent.

3. The internal combustion engine according to claim 1, wherein the sealant and the seal are formed by any one of polysiloxane or polysilazane.

4. The internal combustion engine according to claim 1, wherein the filler particles are made of a material selected from the group consisting of silicon, alumina, boron nitride, silicon nitride, silicon carbide and magnesium oxide.

5. The internal combustion engine according to claim 4, wherein the sealant and the seal are formed by any one of polysiloxane or polysilazane.

6. The internal combustion engine according to claim 1, wherein the diameter of the nano-pores is from 10 to 100 nm.

7. The internal combustion engine according to claim 1, wherein the size of the filler particles is from 10 to 15 nm.

8. The internal combustion engine according to claim 1, wherein the size of the filler particles is from 40 to 50 nm.

9. The internal combustion engine according to claim 1, wherein the size of the filler particles is from 70 to 100 nm.

10. The internal combustion engine according to claim 1, wherein the filler particles are made of silicon dioxide.

11. The internal combustion engine according to claim 1, wherein the surface roughness Ra of the anode oxidation coating film is from 1.51 to 1.74.

12. The internal combustion engine according to claim 1, wherein the surface roughness Ra of the anode oxidation coating film is from 1.51 to 3.58.

* * * * *